US006589919B2

(12) United States Patent
Fukunaga et al.

(10) Patent No.: US 6,589,919 B2
(45) Date of Patent: Jul. 8, 2003

(54) POWDERY MOLD-RELEASING LUBRICANT FOR USE IN CASTING WITH A MOLD AND A MOLD CASTING METHOD

(75) Inventors: Hideharu Fukunaga, Hiroshima (JP); Makoto Yoshida, Hiroshima (JP); Takami Sawai, Osaka (JP)

(73) Assignees: Hiroshima University, Higashi-hiroshima (JP); Hanano Corporation, Kobe (JP)

( * ) Notice: Subject to any disclaimer, the term of this patent is extended or adjusted under 35 U.S.C. 154(b) by 0 days.

(21) Appl. No.: 09/879,552

(22) Filed: Jun. 12, 2001

(65) Prior Publication Data

US 2002/0022580 A1 Feb. 21, 2002

(30) Foreign Application Priority Data

Jun. 13, 2000 (JP) ..... 2000-176649

(51) Int. Cl.[7] ..... C10M 103/00; C10M 169/04; B22D 27/18

(52) U.S. Cl. ..... 508/113; 508/120; 508/122; 508/136; 508/148; 508/154; 508/390; 508/459; 164/72; 164/74

(58) Field of Search ..... 164/72, 74; 508/113, 508/120, 122

(56) References Cited

U.S. PATENT DOCUMENTS 4,046,863 A * 9/1977 Kobayashi et al. ..... 423/448
5,039,435 A * 8/1991 Hanano ..... 106/38.22
5,277,831 A * 1/1994 Hanano ..... 508/155
5,279,749 A * 1/1994 Hanano ..... 508/155
5,279,750 A * 1/1994 Hanano ..... 508/155
5,288,443 A * 2/1994 Lee ..... 264/56
6,117,495 A * 9/2000 Hanson et al. ..... 427/470
6,291,026 B1 * 9/2001 Hanson et al. ..... 427/470
6,432,886 B1 * 8/2002 Reidmeyer ..... 508/114

OTHER PUBLICATIONS

Makoto Yoshida, et al., Development of Clean and Low–energy Die Casting System, Chugoku Technology Promotion Center, Oct. 31, 2000.

* cited by examiner

*Primary Examiner*—Ellen M. McAvoy
(74) *Attorney, Agent, or Firm*—Knobbe Martens Olson & Bear LLP

(57) ABSTRACT

A powdery mold-releasing lubricant according to the present invention uses a powdery mixture of a powdery organic material, which is evaporated or decomposed by heating to generate a gas, and a powdery inorganic material. A gas-solid mixed layer formed with the gas generated from the powdery mixture and the powdery inorganic material is used as a heat-insulating boundary layer. The powdery mold-releasing lubricant is inexpensive and has a superior mold lubricity.

25 Claims, 5 Drawing Sheets

(2 of 5 Drawing Sheet(s) Filed in Color)

A mixture of graphite and wax was uniformly dispersed on the glass

The melt was fed from the left

Flowing direction

Graphite pinned the generated gas to form a uniform gas layer Thus the melt did not directly contact the glass Flowing state of the melt in the case of using a mixture of graphite and wax Metal soap was dissolved on the quartz glass The melt was fed from the left Wax was vaporized between the melt and the glass Flowing state of the melt in the case of using only metal soap (The melt was partly floated by the generated gas and partly contacted the mold (quartz glass) )

POWDERY MOLD-RELEASING LUBRICANT FOR USE IN CASTING WITH A MOLD AND A MOLD CASTING METHOD

BACKGROUND OF THE INVENTION

1. Field of the Invention

The invention relates to a powdery mold-releasing lubricant and a mold casting method, and particularly intends to advantageously improve mold lubricity by effectively combining a powdery organic material which is decomposed or evaporated by heating with a powdery inorganic material.

2. Description of the Related Art

A powdery inorganic material having superior heat insulation and heat retention, such as talc, is used as a powdery mold-releasing lubricant in mold casting processes to reduce a flow rate of heat from a molten metal to a mold. However, in recent years, it is desired to develop such a mold-releasing lubricant that uses an inexpensive powdery inorganic material which does not necessarily have high heat retention to reduce a manufacturing cost of the mold-releasing lubricant.

That is, conventional powdery mold-releasing lubricants have utilized insulating properties of inorganic materials for heat retention of the molten metal, but selection latitude of the inorganic materials available for mold casting have been limited because of a limitation of powdery inorganic materials with good heat-insulation properties. For example, graphite is an inexpensive material and has good solid lubricity. However, since graphite is an electric conductor, its heat conduction caused by motions of free electrons is extremely high as compared to inorganic materials such as oxides, which posses a problem upon heat-insulating property, therefore, graphite cannot be used for such applications that require of heat insulation or heat retention.

As a solution for the above problem, it is considered to use a gas generated by decomposition or evaporation of a material consisting a powder as a heat-insulating boundary layer between the mold and the molten metal instead of utilizing the heat-insulation property of the inorganic material itself. However, it is practically impossible to form a thin heat-insulating boundary layer without any discontinuity between the molten metal flowing in the casting process and the mold from the gas generated by decomposition or evaporation of the organic materials alone.

SUMMARY OF THE INVENTION

The present invention has been developed in due consideration of the above situations. An object of the present invention is to provide a powdery mold-releasing lubricant which is inexpensive and has a good mold-releasing lubricity as well as a mold casting method using such a powdery mold-releasing lubricant.

The present inventors have strenuously repeated the study to achieve the above object. As a result, it is found that the desired object can be advantageously achieved by combining a powdery organic material which is decomposed or evaporated by heating with a powdery inorganic material.

That is, it is found that by mixing a powdery inorganic material and a powdery organic material, a movement of a generated gas is restrained (pinned) with the powder of an inorganic compound, and, as a result, a uniformly thin heat-insulating boundary layer is stably formed without any discontinuity between a mold or a sleeve and a molten metal. Herein, the powdery inorganic material is intended to pin the gas generated by evaporation or decomposition of the powdery organic material to form uniformly thin heat-insulating layer, not to secure the heat-insulating property as in the conventional lubricant.

Although a variety of methods for improving lubricity by mixing powders having different properties have been proposed, among such solid lubricants, there is no example that actively use the generated gas to improve the lubricity.

The gist and the constitution of the invention are as followed. 1) A powdery mold-releasing lubricant for use in casting with a mold, comprising a powdery mixture of a powdery organic material which is evaporated or decomposed by heating to generate a gas and a powdery inorganic material.

2) In the above 1), the powdery inorganic material is a powder of an inorganic material having a solid lubricity, said inorganic material being selected from the group consisting of graphite, kaolinite, SHIRASU (pumice stone) balloons, mica, zirconium silicate, carbon nanotube, carbon isotopes, talc, pyrophylite, crystalline $SiO_2$, magnesium oxide, zirconium silicate, perlite and vermiculite.

3) In the above 1), the powdery inorganic material is a powder of an inorganic material having a solid lubricity, said inorganic material being selected from the group consisting of graphite, kaolinite, SHIRASU(pumice stone) balloons, mica, and zirconium silicate.

4) In the above 1) to 3), a mixed rate of the powdery organic material in the mixture is such an amount that can generate 10–50 ml of a gas per 1 g of the mixture.

5) In the above 1) to 4), an average particle size of the powdery inorganic material in the mixture is 1–30 $\mu$m.

6) In the above 1) to 5), the powdery organic material is selected from the group consisting of polyethylene wax, metal soap, paraffin carbon hydride, sulfonic acid and sulfonic acid salt.

7) A mold casting method, comprising the steps of applying a powdery mold-releasing lubricant in the above 1) to 6) onto internal surfaces of a molding cavity and/or an injection sleeve, and feeding a molten metal into the molding cavity and/or the injection sleeve, whereby gas is generated from the mixture upon contacting between the fed molten metal and the lubricant, a gas-solid mixed layer of the generated gas and the powdery inorganic material is used as a heat-insulating boundary layer.

8) In the above 7), an amount of the powdery mold-releasing lubricant applied on the internal surfaces of the molding cavity and/or the injection sleeve is 0.01–10 g per 1 $m^2$ unit area of.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

In order to explain the invention, reference is made to the accompanying drawings, in which.

DETAILED DISCRIPTION OF THE INVENTION

According to the present invention, a particularly superior heat insulation is not necessary for the inorganic material itself, because a gas generated by evaporation or decomposition of the organic material is used as a mean of reducing a flow rate of heat from the molten metal to the mold. Therefore, selection latitude of powders is widely expanded, and a powder of a low cost inorganic material may be used.

Since the powdery inorganic material does not act as an insulator but primarily as a material for pinning the generated gas, the powdery inorganic material itself may have a low insulation property, and preferably has a superior solid lubricity to prevent an adhesion with the mold. For example, graphite, kaolinite, SHIRASU balloon, mica, boron nitride and the like are particularly advantageously suited. Moreover, the powdery inorganic material is not limited to the above materials, but carbon nanotube, carbon isotopes such as $C_{60}$, talc, pyrophylite, crystalline $SiO_2$, magnesium oxide, zirconium silicate, perlite, vermiculite may preferably be used.

On the other hand, as the powdery organic material, any kind of materials that is in a solid state at the room temperature and generate a gas by evaporation or decomposition by heating can be used. In addition, the material itself is not necessary to have a lubricity at the solid state. Polyethylene wax, metal soap (Ca, Zn and Li soap) and the like are advantageously suitable for such a powdery organic material. Other than the above materials, paraffin carbon hydride, sulfonic acid, sulfonic acid salt or the like may preferably be used.

A method for producing the powdery mold-releasing lubricant is not particularly limited, but the lubricant may be produced by mixing the powdery organic material and the powdery inorganic material having grinded or sorted into the preferred particle size. The lubricant may also be produced by grinding or sorting a powdery mixture of the powdery organic material and the powdery inorganic material.

As mentioned above, when only the powdery organic material is used as the lubricant, i.e. only the generated gas is used, it is practically impossible to form a thin heat-insulating boundary layer without any discontinuity between the molten metal and the mold. On the contrary, according to the invention, when the mixture of the powdery organic material and the powdery inorganic material is used as the lubricant, the gas generated by evaporation or decomposition of the powdery organic material is pinned by the powdery inorganic material to form a uniformly thin insulation layer, and thus good mold-releasing lubricity is exerted.

Figure 1A:
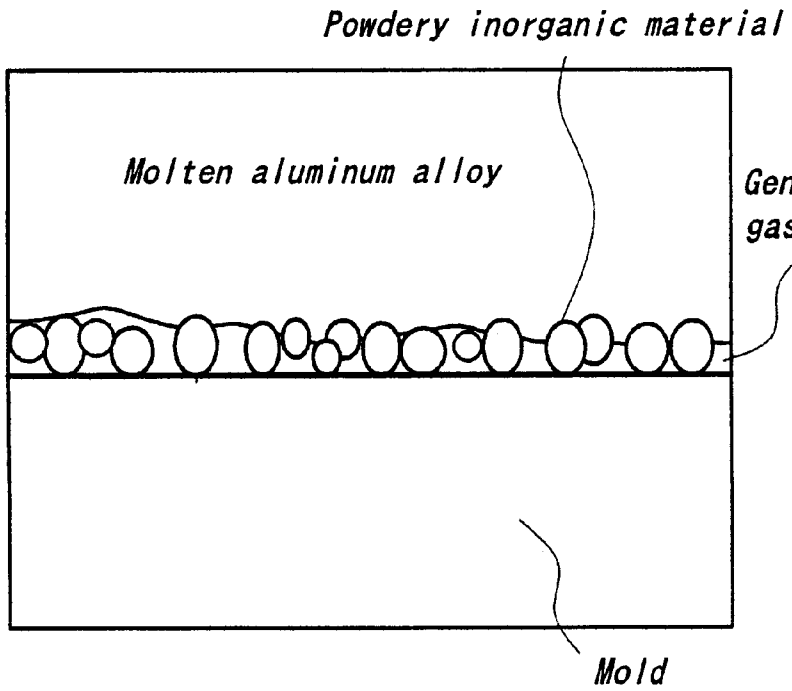
FIG. 1 is a schematic sectional view comparing (a) a case when the mixture of the powdery organic material and the powdery inorganic material according to the invention is used as a lubricant, and (b) a case when only the powdery organic material is used as a lubricant.
Figure 1B:
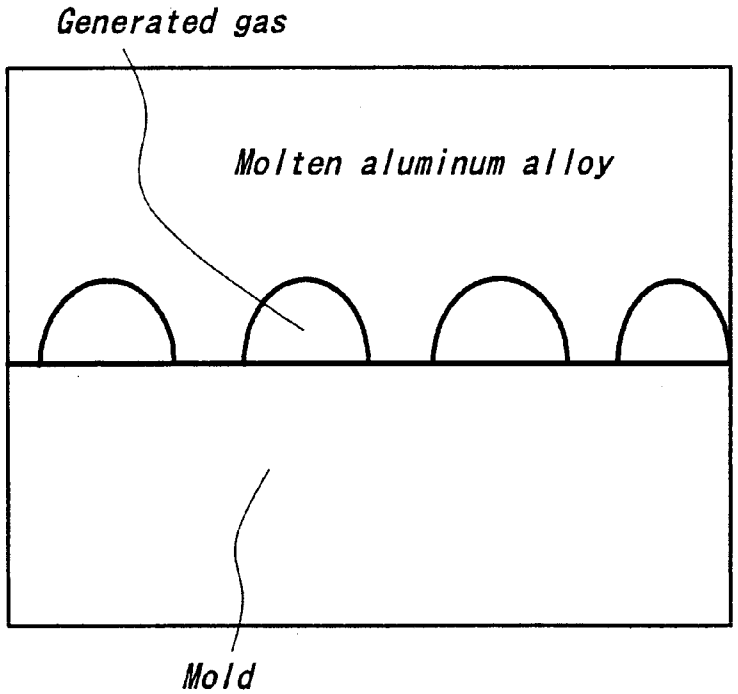

The above mechanisms are shown in FIGS. 1(*a*) and (*b*) as schematic views and will be compared and described. FIG. 1(*a*) illustrates a case when the mixture of the powdery organic material and the powdery inorganic material according to the invention is used as the lubricant, and FIG. 1(*b*) illustrates a case when only the powdery organic material is used as the lubricant. As shown in FIG. 1 (*b*), when only the powdery organic material is used as the lubricant, since the generated gas is divided and a thin heat-insulating boundary layer without any discontinuity is not formed between the molten metal and the mold, the molten metal contacts partially with the mold, from which the heat is radiated to the mold. On the contrary, as shown in FIG. 1 (*a*), when the mixture according to the invention is used as the lubricant, since the generated gas is pinned by the powdery inorganic material to form thin heat-insulating boundary layer without any discontinuity between the molten metal and the mold, the heat is hardly radiated to the mold.

According to the invention, when a mixed rate of the powdery organic material in the mixture is too low, a sufficient heat-insulating effect cannot be acquired. On the contrary, when the rate is too high, problems such as involving the gas into the molten metal are concerned. Therefore, the mixed rate of the powdery organic material is preferably such an amount that can generate about 10–50 ml of gas per 1 g of the mixture.

Figure 2:
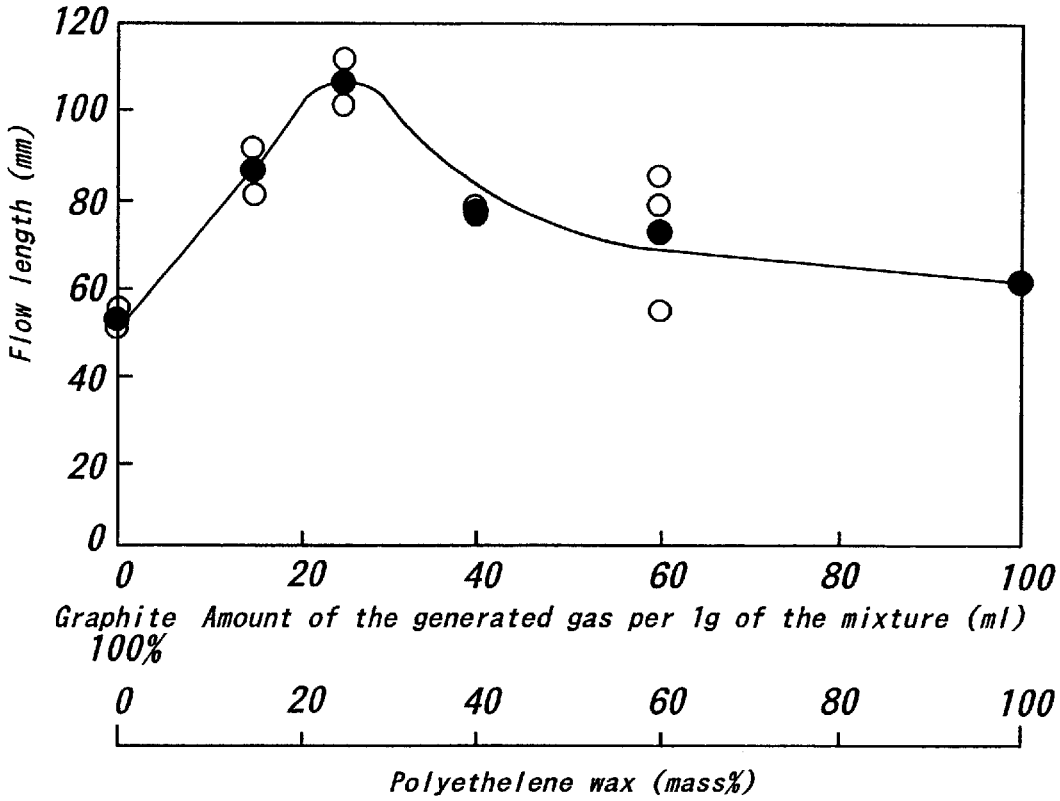
FIG. 2 is a graphical representation showing the relationship between a rate of the powdery organic material in the mixture and a flow length of a molten aluminum alloy.

FIG. 2 shows results which were obtained by investigating the heat-insulating effect, when graphite was used as the powdery inorganic material and polyethylene wax was used as the powdery organic material. The results are given in relation to an amount of the generated gas per 1 g of the mixture. Herein, the insulation effect was evaluated on a flow length of a molten aluminum alloy, when 2 g of the mixture per 1 $m^2$ was applied on the surface of the mold and then the molten aluminum alloy was flown on it. As shown in FIG. 2, the particularly superior heat-insulating effect is obtained where the amount of the generated gas per 1 g of mixture is 10–50 ml. More preferably, the amount is 17–38 ml.

A relationship between the flow length of the molten aluminum alloy and the mixed rate of polyethylene wax in the mixture is also shown in FIG. 2. Polyethylene wax may be included in the range from 10 to 50 mass % to obtain 10–50 ml of the generated gas per 1 g of the mixture, which is required to achieve a superior insulation effect, and in the range from 17 to 38 mass % to obtain 17–38 ml of the generated gas which is more preferable.

When an applicability of the mixed powder and a pinning effect of the powdery inorganic material on the generated gas are taken into consideration, the particle size of the powdery inorganic material in the mixture is also important. The inventors investigated this point and found that a good result is obtained when the average particle size of the powdery inorganic material is 1–30 $\mu$m. The particle size of the powdery organic material is not particularly limited, but 1–30 $\mu$m, same as the powdery inorganic material, is preferable since the powder absorbs many water molecules and as a result aggregation of the powder tends to occur to lower the applicability to the mold when the particle size is too much small, and especially for an aluminum alloy, smoothness of the surface of the casting is lowered to result in a nonconforming product when the particle size is too much large.

Moreover, although an applying method is not particularly limited when such mixture is to be applied on the internal surface of the molding cavity for mold casting or that of the injection sleeve, such a method that the mixture is introduced into the mold with air by a vacuum suction method to be adhered on the surface of the mold is advantageously suited in the case of the mold being closed. On the other hand, such a method that the mixture is blown or is adhered on the surface of the mold by an electrostatic power is advantageously suited in the case of the mold being opened.

In addition, the amount of the applied powder is not particularly limited, but about 0.01–10 g per 1 $m^2$ is preferable. Because a sufficient insulation effect cannot be achieved when the amount of the applied powder is less than 0.01 $g/m^2$, and an involvement of the gas into the molten metal is concerned when the amount of the applied powder is more than 10 $g/m^2$. More preferably, the amount is in the range from 0.5 to 2.0 g. The mold casting according to the present invention refers to all the castings that cast with molds such as a die casting, a gravity casting and high-pressure casting.

In this way, according to the present invention, a uniformly thin heat-insulating boundary layer comprising the mixed layer of the powdery inorganic material and the generated gas is formed between the casting mold or the sleeve and the molten metal, when the mixture is contacted with the molten metal during the casting process. Therefore, while the molten metal floats and flows on the solid-gas mixed layer without a direct contact with the mold or the sleeve, the molten metal is filled in the cavity, therefore, the flow rate of heat from the molten metal to the mold or the sleeve is remarkably reduced.

EXAMPLE

Figure 3:
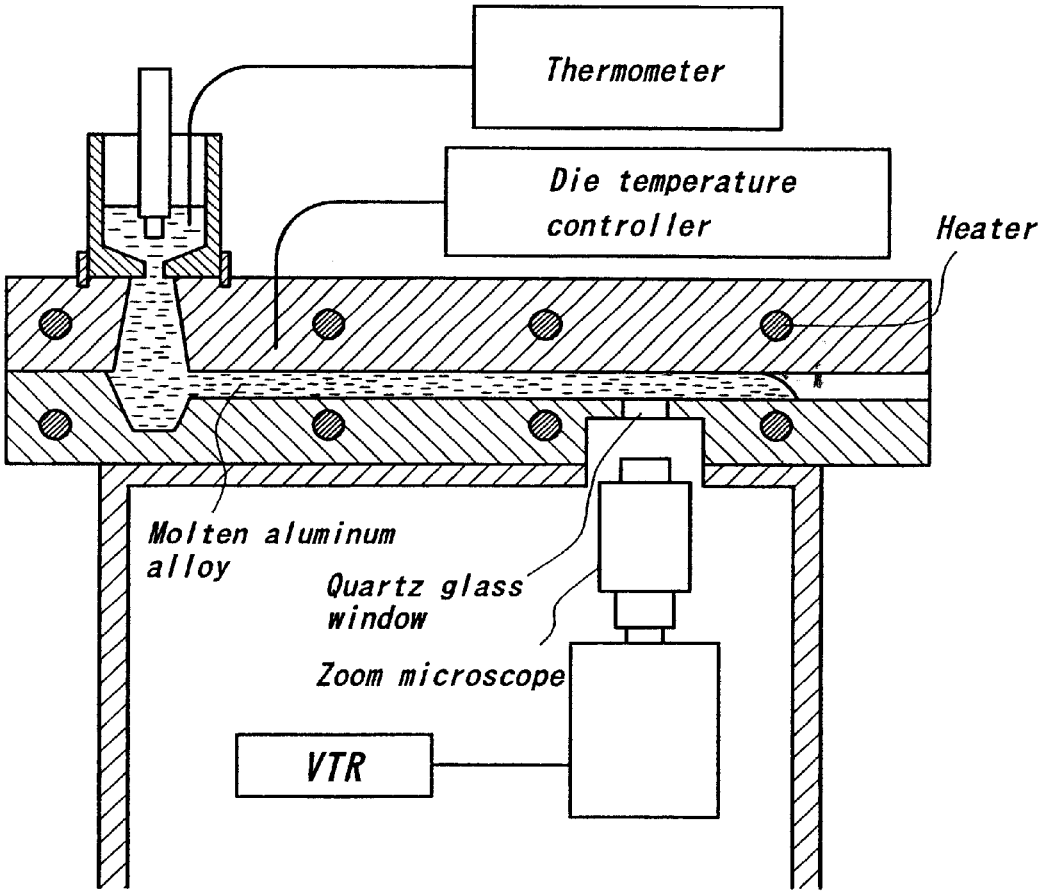
FIG. 3 is a schematic diagram showing a mold casting device used in the example of the invention for confirming a presence of a heat-insulating boundary layer between a casting mold and a molten metal.

Polyethylene wax having the average particle size of 5 $\mu$m and graphite having an average particle size of 11 $\mu$m were used as the powdery organic material and the powdery inorganic material, respectively, and were mixed to give a rate of the powdery organic material in the mixture to be 25 mass %. The rate of the powdery organic material was corresponding to 30 ml of an amount of the generated gas per 1 g of the mixture. The mixture was introduced into the mold shown in FIG. 3 with air by a vacuum suction method to be adhered on the surface of the mold at a rate of 2 $g/m^2$. Then a molten aluminum alloy of 650° C. was injected into the mold.

Figures 4A, 4B, 4C:
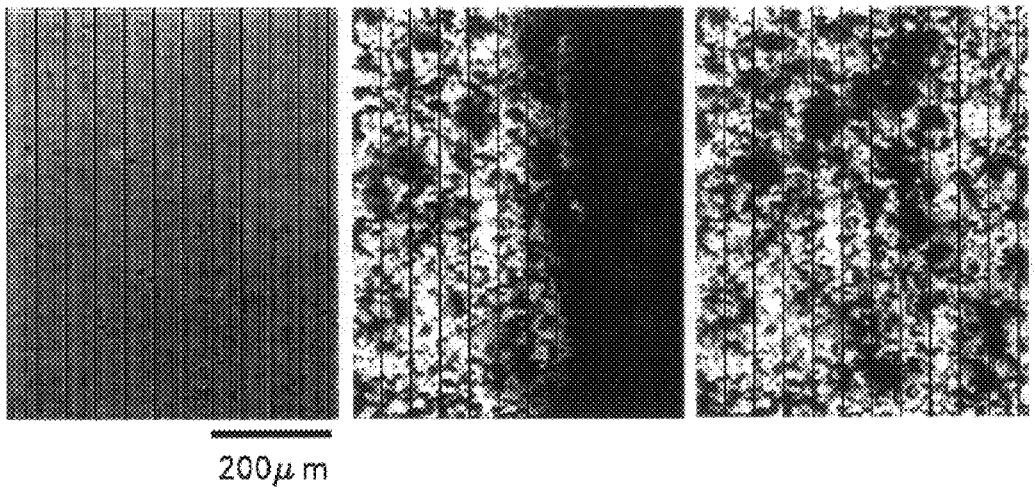
FIG. 4(*a*) to FIG. 4(*c*) are microscopic photographs in the case that a mixture of a powdery organic material and a powdery inorganic material according to the invention are used as a lubricant, which illustrate a forming state of a heat-insulating boundary layer comprising a mixed layer of a generated gas and the powdery inorganic material, and a contacting state between the molten metal and the internal surface of the mold.
Figures 5A, 5B, 5C:
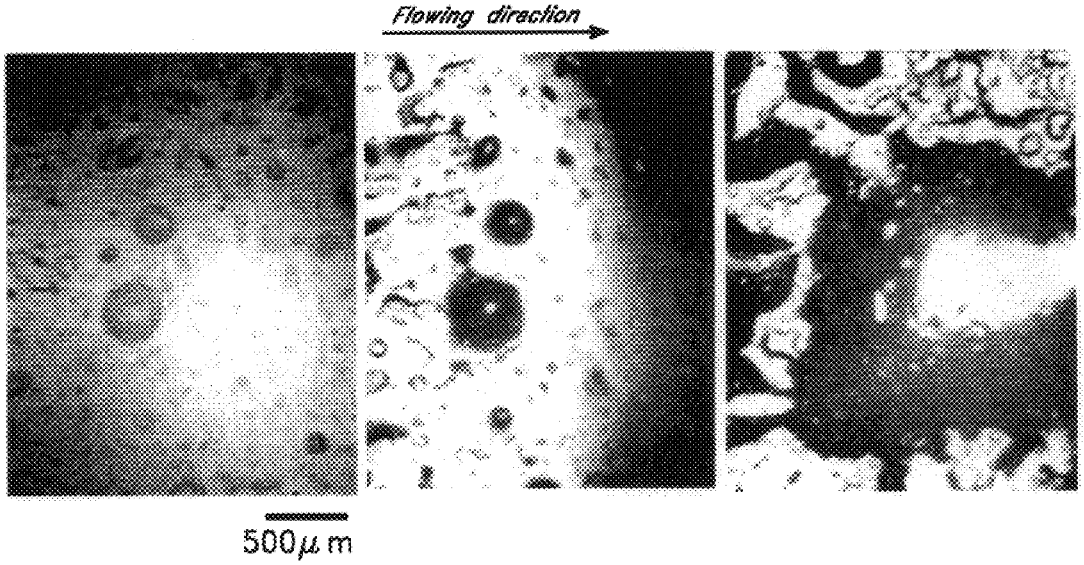
FIG. 5(*a*) to FIG. 5(*c*) are microscopic photographs in the case that only a powdery organic material is used as a lubricant, which illustrate a forming state of the heat-insulating boundary layer of a generated gas, and a contacting state between the molten metal and the internal surface of the mold.

A formation of the heat-insulating boundary layer comprising the mixed layer of the generated gas and the powdery inorganic material was directly observed by using a zoom microscope and super-high-speed video photography with a mold having a quartz glass window. The boundary layer-forming state with the lapse of the time are shown in FIGS. 4(*a*), (*b*) and (*c*). As shown in the figures, when the mixture according to the invention was used, a uniformly thin heat-insulating boundary layer comprising the mixed layer of the powdery inorganic material and the generated gas was formed on the surface of the mold. For comparison, the formation of the heat-insulating boundary layer was investigated when only the powdery organic material was used, and results are shown in FIGS. 5(*a*), (*b*) and (*c*). As shown in the figures, in this case, although some regions where the molten metal was floated by the generation of the gas could be seen, the molten metal was contacted with the mold over a wide region.

Then, in the same manner as aforementioned, it was examined how thin the casting products could be produced. As a result, it was confirmed that a thin, large product of an aluminum alloy having a thickness of 0.5 mm and an area of 1 $m^2$ could be cast by forming the heat-insulating boundary layer according to the present invention.

As having been described above, according to the present invention, by using the mixture of the powdery organic material which generate the gas by evaporation or decomposition by heating and the powdery inorganic material as the mold-releasing lubricant, a thin heat-insulating boundary layer can be formed without any discontinuity between the molten metal and the mold. Further, because of an improvement of the heat retention in the sleeve or the casting mold, a thin, large casting products which have been difficult to cast by the conventional method can be cast. In addition, as the present invention utilizes the superior heat-insulating property of the generated gas, an expensive material having superior heat insulation and heat retention is not particularly necessary to use as the powdery inorganic material, thus a tremendous cost reduction may be achieved.

What is claimed is:

1. A powdery mold-releasing lubricant for use in casting with a mold, comprising a powdery mixture of (a) a powdery organic material which is evaporated or decomposed by heating to generate 10–50 ml gas per 1 g of the mixture, and (b) a powdery inorganic material.

2. A powdery mold-releasing lubricant according to claim 1, wherein the powdery inorganic material is a powder of an inorganic material having a solid lubricity, said inorganic material being selected from the group consisting of graphite, kaolinite, SHIRASU (pumice stone) balloons, mica, zirconium silicate, carbon nanotube, carbon isotopes, talc, pyrophylite, crystalline $SiO_2$, magnesium oxide, zirconium silicate, perlite and vermiculite.

3. A powdery mold-releasing lubricant according to claim 1, wherein the powdery inorganic material is a powder of an inorganic material having a solid lubricity, said inorganic material being selected from the group consisting of graphite, kaolinite, SHIRASU (pumice stone) balloons, mica, and zirconium silicate.

4. A powdery mold-releasing lubricant according to claim 1, wherein an average particle size of the powdery inorganic material in the mixture is 1–30 $\mu$m.

5. A powdery mold-releasing lubricant according to claim 1, wherein an average partical size of the powdery inorganic material in the mixture is 1–30 $\mu$m.

6. A powdery mold-releasing lubricant according to claim 1, wherein the powdery organic material is selected from the group consisting of polyethylene wax, metal soap, paraffin carbon hydride, sulfonic acid and sulfonic acid salt.

7. A powdery mold-releasing lubriant according to claim 1, wherein the powdery organic material is selected from the group consisting of polyethylene wax, metal soap, paraffin carbon hydride, sulfonic acid and silfonic acid salt.

8. A powdery mold-releasing lubricant according to claim 4, wherein the powdery organic material is selected from the group consisting of polyethylene wax, metal soap, paraffin carbon hydride, sulfonic acid and sulfonic acid salt.

9. A powdery mold-releasing lubricant according to claim 5, wherein the powdery organic material is selected from the group consisting of polyethylene wax, metal soap, paraffin carbon hydride, sulfonic acid and sulfonic acid salt.

10. A mold casting method, comprising the steps of applying a powdery mold-releasing lubricant according to claim 1 onto internal surfaces of a molding cavity and/or an injection sleeve, and feeding a molten metal into the molding cavity and/or the injection sleeve, whereby gas is generated from the mixture upon contacting between the fed molten metal and the lubricant, a gas-solid mixed layer of the generated gas and the powdery inorganic material is used as a heat-insulating boundary layer.

11. A mold casting method, comprising the steps of applying a powdery mold-releasing lubricant according to claim 1 onto internal surfaces of a molding cavity and/or an injection sleeve, and feeding a molten metal into the molding cavity and/or injection sleeve, whereby gas is generated from the mixture upon contacting between the fed molten metal and the lubricant, a gas-solid mixed layer of the generated gas and the powdery inorganic material is used as a heat-insulating boundary layer.

12. A mold casting method, comprising the steps of applying a powdery mold-releasing lubricant according to claim 4 onto internal surfaces of a molding cavity and/or an injection sleeve, and feeding a molten metal into the molding cavity and/or the injection sleeve, whereby gas is generated from the mixture upon contacting between the fed molten metal and the lubricant, a gas-solid mixed layer of the generated gas and the powdery inorganic material is used as a heat-insulating boundary layer.

13. A mold casting method, comprising the steps of applying a powdery mold-releasing lubricant according to claim 5 onto internal surfaces of a molding cavity and/or an injection sleeve, and feeding a molten metal into the molding cavity and/or the injection sleeve, whereby gas is generated from the mixture upon contacting between the fed molten metal and the lubricant, a gas-solid mixed layer of the generated gas and the powdery inorganic material is used as a heat-insulating boundary layer.

14. A mold casting method, comprising the steps of applying a powdery mold-releasing lubricant according to claim 6 onto internal surfaces of a molding cavity and/or an injection sleeve, and feeding a molten metal into the molding cavity and/or the injection sleeve, whereby gas is generated from the mixture upon contacting between the fed molten metal and the lubricant, a gas-solid mixed layer of the generated gas and the powdery inorganic material is used as a heat-insulating boundary layer.

15. A mold casting method, comprising the steps of applying a powdery mold-releasing lubricant according to claim 7 onto internal surfaces of a molding cavity and/or an injection sleeve, and feeding a molten metal into the molding cavity and/or the injection sleeve, whereby gas is generated from the mixture upon contacting between the fed molten metal and the lubricant, a gas-solid mixed layer of the generated gas and the powdery inorganic material is used as a heat-insulating boundary layer.

16. A mold casting method, comprising the steps of applying a powdery mold-releasing lubricant according to claim 8 onto internal surfaces of a molding cavity and/or an injection sleeve, and feeding a molten metal into the molding cavity and/or the injection sleeve, whereby gas is generated from the mixture upon contacting between the fed molten metal and the lubricant, a gas-solid mixed layer of the generated gas and the powdery inorganic material is used as a heat-insulating boundary layer.

17. A mold casting method, comprising the steps of applying a powdery mold-releasing lubricant according to claim 9 onto internal surfaces of a molding cavity and/or an injection sleeve, and feeding a molten metal into the molding cavity and/or the injection sleeve, whereby gas is generated from the mixture upon contacting between the fed molten metal and the lubricant, a gas-solid mixed layer of the generated gas and the powdery inorganic material is used as a heat-insulating boundary layer.

18. A mold casting method according to claim 10, wherein an amount of the powdery mold-releasing lubricant applied on the internal surfaces of the molding cavity and/or the injection sleeve is 0.01–10 g per 1 $m^2$ unit area of.

19. A mold casting method according to claim 11, wherein an amount of the powdery mold-releasing lubricant applied on the internal surfaces of the molding cavity and/or the injection sleeve is 0.01–10 g per 1 $m^2$ unit area of.

20. A mold casting method according to claim 12, wherein an amount of the powdery mold-releasing lubricant applied on the internal surfaces of the molding cavity and/or the injection sleeve is 0.01–10 g per 1 $m^2$ unit area of.

21. A mold casting method according to claim 13, wherein an amount of the powdery mold-releasing lubricant applied on the internal surfaces of the molding cavity and/or the injection sleeve is 0.01–10 g per 1 $m^2$ unit area of.

22. A mold casting method according to claim 14, wherein an amount of the powdery mold-releasing lubricant applied on the internal surfaces of the molding cavity and/or the injection sleeve is 0.01–10 g per 1 $m^2$ unit area of.

23. A mold casting method according to claim 15, wherein an amount of the powdery mold-releasing lubricant applied on the internal surfaces of the molding cavity and/or the injection sleeve is 0.01–10 g per 1 $m^2$ unit area of.

24. A mold casting method according to claim 16, wherein an amount of the powdery mold-releasing lubricant applied on the internal surfaces of the molding cavity and/or the injection sleeve is 0.01–10 g per 1 $m^2$ unit area of.

25. A mold casting method according to claim 17, wherein an amount of the powdery mold-releasing lubricant applied on the internal surfaces of the molding cavity and/or the injection sleeve is 0.01–10 g per 1 $m^2$ unit area of.

* * * * *